United States Patent [19]

Tsujimoto et al.

[11] Patent Number: 4,712,366

[45] Date of Patent: Dec. 15, 1987

[54] DENIER-MIXED COMPOSITE YARN, DENIER-MIXED SPECIAL THICK AND THIN YARN, FALSE TWIST YARN AND DENIER-MIXED SHRINKAGE-MIXED COMPOSITE YARN

[75] Inventors: Keizo Tsujimoto; Takashi Katagiri; Eiji Ichihashi; Hitoshi Otsubo, all of Okazaki, Japan

[73] Assignee: Nippon Ester Co., Ltd., Aichi, Japan

[21] Appl. No.: 945,382

[22] Filed: Dec. 22, 1986

[30] Foreign Application Priority Data

Dec. 28, 1985 [JP] Japan ..... 60-298563
May 19, 1986 [JP] Japan ..... 61-114083

[51] Int. Cl.[4] ..... D02G 3/22; D02G 3/24; D02G 3/38; D02G 1/02

[52] U.S. Cl. ..... 57/245; 57/206; 57/244; 57/247; 57/248; 57/253; 57/254; 57/255; 428/362; 428/369; 428/373; 428/397

[58] Field of Search ..... 57/238, 239, 243–248, 57/252–257, 206–209; 428/362, 364, 369–374, 397–400

[56] References Cited

U.S. PATENT DOCUMENTS 3,846,969 11/1974 McKay ..... 57/248 X
3,998,042 12/1976 Reese ..... 428/369 X
4,263,777 4/1981 Wada et al. ..... 57/253 X
4,292,799 10/1981 Otaki et al. ..... 57/246
4,307,566 12/1981 Murata et al. ..... 428/370 X
4,466,237 8/1984 Sawyer ..... 57/254
4,472,481 9/1984 Snooks, Jr. et al. ..... 428/362
4,487,011 12/1984 Heinrich et al. ..... 57/248 X
4,634,625 1/1987 Franklin ..... 428/369 X

FOREIGN PATENT DOCUMENTS 55-6517 1/1980 Japan .
58-115145 7/1983 Japan .

*Primary Examiner*—John Petrakes
*Attorney, Agent, or Firm*—Joseph W. Farley

[57] ABSTRACT

The present invention relates to a denier-mixed composite yarn containing 20 weight percent or more coarse filaments whose single filament fineness is 3 deniers or more and 5 weight percent or more fine filaments whose single filament fineness is 1.5 denier or less. Part or all of the coarse filaments are of non-circular cross-section, the stress of the composite yarn at 10% elongation is 2.5 g/d or less, and the composite yarn has a particular distribution of elongation. According to such denier-mixed composite yarn, superior dry feel fullness and softness can be imparted to woven and knit fabrics.

16 Claims, 22 Drawing Figures j :

k :

l :

m :

n :

o :

p :

DENIER-MIXED COMPOSITE YARN, DENIER-MIXED SPECIAL THICK AND THIN YARN, FALSE TWIST YARN AND DENIER-MIXED SHRINKAGE-MIXED COMPOSITE YARN

TECHNICAL FIELD

The present invention relates to a denier-mixed composite yarn giving improved dry feel and fullness and softness to woven and knit fabrics and it also relates to a special thick and thin yarn, an antistatic yarn, a twisted yarn, a false twist yarn and a shrinkage-mixed denier-mixed composite yarn, which utilize the technique of said denier-mixed composite yarn.

BACKGROUND ART

Heretofore, in order to eliminate smoothness, limp touch and CHIKA (the appearance of a cloth with splashed patterns) which are drawbacks of synthetic fibers and to give fullness and softness to woven and knit fabrics, attempts have been made to make the cross section of single filament non-circular or make single filaments differ in fineness so as to give soft feel.

For example, a non-circular cross-sectional denier-mixed composite yarn having a triangular or star-shaped cross section having projections has been proposed as giving a hand without luster or smoothness, which has not been attained with conventional synthetic fibers (Japanese Patent Application Laid-Open No. 6517/1980)

However, if such non-circular cross-sectional denier-mixed composite yarn is woven or knit into a fabric without incorporating any contrivance, although the fabric is free to some degree from the smoothness peculiar to synthetic fibers and adds to soft feel and fullness and softness, it still lacks dry feel.

Further, there has been proposed a non-circular cross-sectional yarn wherein the cross-sectional shape of single filaments is made very sharp in order to give dry feel to woven and knit fabrics. With this fiber, however, the sharp cross-sectional shape, through improving void factor in single filaments, results in such drawbacks as metallic luster and a hand representing paper-like roughness. Further, if such yarn is given a real or false twist of 2,000–5,000 turns per meter, because of the sharp cross section making the projecting portions less resistant to turning force, the projecting portions are deformed. If the single filaments have approximately equal fineness, they are excessively tightly packed by rotating around each other and hence the void factor is decreased, resulting in a hand representing limp touch.

That is, so far as synthetic fibers are used, it has heretofore been impossible to produce a rustic woven or knit fabric having drape or soft feel which is a property of natural silk and wool and also having tightness, stiffness and dry feel.

SUMMARY OF THE INVENTION

A first object of the invention is to provide a denier-mixed composite yarn suitable for making woven and knit fabrics having fresh dry feel and soft fullness. A second object of the invention is to provide a denier-mixed special thick and thin composite yarn suitable for making woven and knit fabrics having unevenness and a very high degree of dry feel in addition to the properties of the first object. A third object of the invention is to provide a denier-mixed composite yarn which is capable of giving an anti-static property, in addition to the properties of the first object, to woven and knit fabrics. A fourth object of the invention is to provide a denier-mixed composite yarn suitable for making woven fabrics using twisted yarns, superior in dry feel and soft feel. A fifth object of the invention is to provide a false twist yarn making it possible to emphasize dry feel and fullness and softness in woven and knit fabrics. A sixth object of the invention is to provide a denier-mixed shrinkage-mixed composite yarn making it possible to further emphasize fullness and softness in addition to dry feel.

A first aspect of the invention resides in a denier-mixed elongation-mixed composite yarn containing 20 weight percent or more coarse filaments whose single filament fineness is 3 deniers or more and 5 weight percent or more fine filaments whose single filament fineness is 1.5 denier or less, characterized in that part or all of said coarse filaments are of non-circular cross-section, the stress of said composite yarn at 10% elongation is 2.5 g/d or less, and the following relations (I) and (II) are satisfied:

$$E_{max} - E_{min} \geqq 20(\%) \quad \text{(I)}$$

$$E_{i+1} - E_i \leqq 20(\%) \quad \text{(II)}$$

where $E_{max}$ is the elongation (%) of the maximum elongation single filament constituting the composite yarn, $E_{min}$ the elongation (%) of the single filament exhibiting minimum elongation, $E_i$ the elongation (%) of any single filament (excluding the maximum elongation single filament) constituting the composite yarn, and $E_{i+1}$ the elongation (%) of the single filament which exhibits elongation greater than and closest to $E_i$.

A second aspect of the invention resides in a denier-mixed special thick and thin composite yarn containing 20 weight percent or more coarse filaments whose single filament fineness is 3 deniers or more and 5 weight percent or more fine filaments whose single filament fineness is 1.5 denier or less, at least part of said coarse filaments having thick and thin portions lengthwise thereof, characterized in that part or all of said coarse filaments are of non-circular cross-section, the stress of said composite yarn at 10% elongation is 2.5 g/d or less, and the following relations (I) and (II) are satisfied:

$$E_{max} - E_{min} \geqq 20(\%) \quad \text{(I)}$$

$$E_{i+1} - E_i \leqq 20(\%) \quad \text{(II)}$$

where $E_{max}$ is the elongation (%) of the maximum elongation single filament constituting the composite yarn, $E_{min}$ the elongation (%) of the minimum elongation single filament constituting the composite yarn, $E_i$ the elongation (%) of any single filament (excluding the maximum elongation single filament) constituting the composite yarn, and $E_{i+1}$ the elongation (%) of the single filament which exhibits elongation greater than and closest to $E_i$.

A third aspect of the invention resides in a denier-mixed composite yarn containing 20 weight percent or more coarse filaments whose single filament fineness is 3 deniers or more and 5 weight percent or more fine filaments whose single filament fineness is 1.5 denier or less, characterized in that part or all of said coarse filaments are of non-circular cross-section, the stress of said composite yarn at 10% elongation is 2.5 g/d or less, at least all of said coarse filaments are of sheath-core construction, the core component alone contains a compound having anti-static property, and the following relations (I) and (II) are satisfied:

$$E_{max}-E_{min}\geqq 20(\%) \quad \text{(I)}$$

$$E_{i+1}-E_i\leqq 20(\%) \quad \text{(II)}$$

Where $E_{max}$ is the elongation (%) of the maximum elongation single filament constituting the composite yarn, $E_{min}$ the elongation (%) of the minimum elongation single filament constituting the composite yarn, $E_i$ the elongation (%) of any single filament (excluding the maximum elongation single filament) constituting the composite yarn, and $E_{i+1}$ the elongation (%) of the single filament which exhibits elongation greater than and closest to $E_i$.

A fourth aspect of the invention resides in a denier-mixed composite yarn for woven fabrics using twisted yarns, said denier-mixed composite yarn being obtained by twisting a denier-mixed composite yarn containing 20 weight percent or more coarse filaments whose single filament fineness is 3 deniers or more and 5 weight percent or more fine filaments whose single filament fineness is 1.5 denier or less, characterized in that part or all of said coarse filaments are of non-circular cross-section, the stress of said composite yarn at 10% elongation is 2.5 g/d or less, the following relations (I) and (II) satisfied, and said composite yarn has a twist such that its twist constant (K) defined by the following relation (V) is 2000–35000:

$$E_{max}-E_{min}\geqq 20(\%) \quad \text{(I)}$$

$$E_{i+1}-E_i\leqq 20(\%) \quad \text{(II)}$$

Where $E_{max}$ is the elongation (%) of the maximum elongation single filament constituting the composite yarn, $E_{min}$ the elongation (%) of the minimum elongation single filament constituting the composite yarn, $E_i$ the elongation (%) of any single filament (excluding the maximum elongation single filament) constituting the composite yarn, and $E_{i+1}$ the elongation (%) of the single filament which exhibits elongation greater than and closest to $E_i$, $$K=T\sqrt{D} \quad \text{(V)}$$

Where T is the number of turns of twist (T/M), and D is the yarn fineness (in deniers).

A fifth aspect of the invention resides in false twist yarn obtained by false twisting a denier-mixed composite yarn containing 20 weight percent or more coarse filaments whose single filament fineness is 3 deniers or more and 5 weight percent or more fine filaments whose single filament fineness is 1.5 denier or less, characterized in that part or all of said coarse filaments are of non-circular cross-section, the stress of said composite yarn at 10% elongation is 2.5 g/d or less, the following relations (I) and (II) are satisfied, and at the same time the following relations (VI) and (VII) are also satisfied:

$$E_{max}-E_{min}\geqq 20(\%) \quad \text{(I)}$$

$$E_{i+1}-E_i\leqq 20(\%) \quad \text{(II)}$$

Where $E_{max}$ is the elongation (%) of the maximum elongation single filament constituting the composite yarn, $E_{min}$ the elongation (%) of the minimum elongation single filament constituting the composite yarn, $E_i$ the elongation (%) of any single filament (excluding the maximum elongation single filament) constituting the composite yarn, and $E_{i+1}$ the elongation (%) of the single filament which exhibits elongation greater than and closest to $E_i$, $$1.10\leqq R(H) \quad \text{(VI)}$$

$$1.07\geqq R(h) \quad \text{(VII)}$$

Where R(H) is the ratio ($H_{max}/H_{min}$) of the length of the single filament fiber having the greatest length ($H_{max}$) constituting the composite yarn to the length of the single filament fiber having the least length ($H_{min}$) constituting the composite yarn, and R(h) is the ratio ($h_{i+1}/h_i$), to the length ($h_i$) of any single filament constituting the composite yarn, of the length ($h_{i+1}$) of the single filament constituting the composite yarn which length is greater than and closest to ($h_i$).

A sixth aspect of the invention resides in a denier-mixed shrinkage-mixed composite yarn composed of a high-shrinkage component and a low-shrinkage component, at least the low shrinkage component containing 20 weight percent or more coarse filaments whose single filament fineness is 3 deniers or more and 5 weight percent or more fine filaments whose single filament fineness is 1.5 denier or less, characterized in that part or all of said coarse filaments are of non-circular cross-section, the stress of said composite yarn at 10% elongation is 2.5 g/d or less, and the following relations (I) and (II) are satisfied:

$$E_{max}-E_{min}\leqq 20(\%) \quad \text{(I)}$$

$$E_{i+1}-E_i\geqq 20(\%) \quad \text{(II)}$$

Where $E_{max}$ is the elongation (%) of the maximum elongation single filament constituting the composite yarn, $E_{min}$ the elongation (%) of the minimum elongation single filament constituting the composite yarn, $E_i$ the elongation (%) of any single filament (excluding the maximum elongation single filament) constituting the composite yarn, and $E_{i+1}$ the elongation (%) of the single filament which exhibits elongation greater than and closest to $E_i$.

DETAILED DESCRIPTION OF THE PREFERRED EMBODIMENTS

Figure 1:
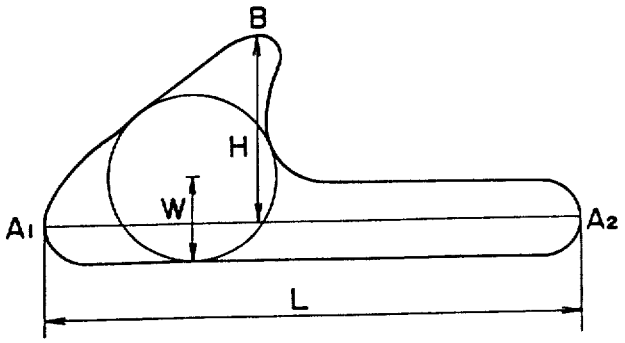
FIGS. 1(A) and 1(B) are sectional views of special flat cross-sectional yarns having forms of the non-circular cross section of single filament according to an embodiment of the present invention.
Figure 1:
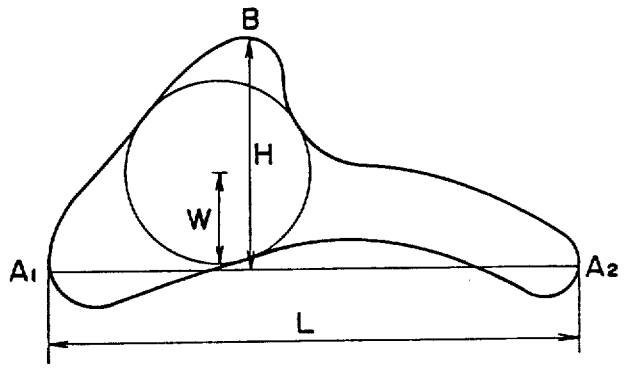

As a result of our investigation with attention paid to the properties of single filaments constituting a denier-mixed composite yarn in an effort to obtain a rustic woven or knit fabric superior in dry feel and fullness and softness, we have found that by satisfying a particular elongation distribution and reducing stress at 10% elongation, it is possible to obtain a yarn which satisfies such contradictory properties as tightness, stiffness and dry feel on the one hand and drape, soft feel and fullness and softness on the other hand, as mentioned above, leading to the accomplishment of the present invention.

That is, the invention is intended to obtain a denier-mixed elongation-mixed composite yarn containing 20 weight percent or more coarse filaments whose single filament fineness is 3 deniers or more and 5 weight percent or more fine filaments whose single filament fineness is 1.5 denier or less, characterized in that part or all of said coarse filaments are of non-circular cross-section, the stress of said composite yarn at 10% elongation is 2.5 g/d or less, and the following relations (I) and (II) are satisfied:

$$E_{max}-E_{min}\geqq 20(\%) \quad \text{(I)}$$

$$E_{i+1}-E_i\leqq 20(\%) \quad \text{(II)}$$

Where $E_{max}$ is the elongation (%) of the maximum elongation single filament constituting the composite yarn, $E_{min}$ the elongation (%) of the single filament exhibiting minimum elongation, $E_i$ the elongation (%) of any single filament (excluding the maximum elongation single filament) constituting the composite yarn; and $E_{i+1}$ the elongation (%) of the single filament which exhibits elongation greater than and closest to $E_i$.

The invention will now be described in more detail.

As for the construction of the single filaments of a denier-mixed elongation-mixed composite yarn so called in the invention, it is necessary that a coarse filament whose fineness is 3 deniers or more and a fine filament whose fineness is 1.5 denier or less be harmoniously united together. That is, the presence of the coarse filament provides a hand representing tightness, stiffness or dry feel, while the presence of the fine filament provides a woven or knit fabric having soft feel, fullness and softness or drape.

On the other hand, if the fineness of the coarse filaments is 3 deniers or less, a repulsive force against a transverse force or a bending or twisting force on the single filaments could hardly be expected because of the small cross-sectional area of the single filaments, resulting in decreased stiffness and tightness, and the little difference between their fineness and that of the fine filaments would result in smooth fabric lacking in unevenness, a fact which is not desirable. Therefore, to obtain a woven or knit fabric having tightness, stiffness or dry feel, it is preferable that the single filament fineness be 3 deniers or more, particularly in the range of 4–7 deniers; however, if a yarn composed of coarse filaments only is woven or knit into a fabric, the fabric would have a rigid hand, somewhat lacking in soft feel or drape, a fact which is not desirable.

Accordingly, it is required that the fineness arrangement of the single filaments of a denier-mixed elongation-mixed composite yarn in the present invention be such that the coarse filaments be present in an amount of 20 weight percent or more and the fine filaments whose fineness is 1.5 denier or less be present in an amount of 5 weight percent or more in order to provide soft feel at the same time. In the present invention, if the proportion of said coarse filaments is less than 20 weight percent, dry feel, fullness and softness would be lost, a fact which is not desirable. If the amount of the fine filaments whose fineness is 1.5 denier or less is less than 5 weight percent, the influence of said coarse filaments would be so high that it would destroy soft feel, resulting in a woven or knit fabric with some stiffness, a fact which is not desirable.

In the invention, the proportions of said coarse and fine filaments are not specifically restricted if they are within the aforesaid ranges, within which they may be suitably changed according to a desired hand.

Further, in the invention, it is required that the elongation distribution of the each filaments constituting the composite yarn satisfy the following relations (I) and (II) at the same time:

$$E_{max}-E_{min}\geqq 20(\%) \quad \text{(I)}$$

$$E_{i+1}-E_i\leqq 20(\%) \quad \text{(II)}$$

That is, when the denier-mixed composite yarn is considered from a macroscopic point of view, there is no particular restriction on the elongation of the composite yarn in its entirety as to the average value (though there is, of course, a common sense limit when the capacity for passage through post-treatment is considered), but in order to develop the hand intended by the invention, it is necessary that the difference between the maximum and minimum elongations be 20% or more, preferably 40–80% and that the difference in elongation between two single filaments closest to each other in terms of elongation be 20% or less, preferably relatively as low as 15% or less.

As described above, the composite yarn of the invention necessarily contains 20 weight percent or more coarse filaments whose fineness is 3 deniers or more (it being noted that heretofore, coarse filaments whose fineness is 3 deniers or more have been seldom used as flat yarn for silky woven and knit fabrics), with the result that dry feel is inevitably emphasized, tending to give roughness and stiffness. Thus, by controlling elongation as described above, such tendency is suppressed so as to give a soft hand.

Futher, because of the elongation having a particular distribution, natural, rustic woven and knit fabrics free of unifomity and monotony can be obtained.

On the other hand, if the difference between the maximum and minimum elogations of component single filaments is less than 20%, the degree of orientation of the single filaments would be inevitably high and they would be uniformly oriented, destroying soft feel and natural feel, a fact which is not desirable.

Further, if the difference in elongation between two single filaments closest to each other in terms of elongation is greater than 20%, yarn cracks or loops would develop owing to the difference in filament length in post-processes including warping and sizing, a fact which is not desirable.

The cross-sectional shapes of the coarse and fine filaments constituting the yarn of the invention are not particularly restricted, but in order to achieve the objects of the invention most effectively, it is required that part or all of the coarse filaments be of non-circular cross section.

Suitable examples of non-circular cross section include well-known multilobular and flat forms and a special cross section resulting from a combination thereof. From the standpoint of the objects of the invention, it is suitable to prepare a particular cross-sectional yarn wherein part or all of the coarse filaments are of crisscross cross section, a special flat cross sectional yarn having rotation-asymmetric cross section which consists of a substantially straight flat base portion and projections or a W-shaped cross-sectional yarn.

Particularly, if part or all of the coarse filaments are of special flat cross section in rotation-asymmetric form having a substantially straight base portion and a projection as shown in FIG. 1, it is preferable that the following relations (III) and (IV) be satisfied. This makes it possible to prevent single filaments from rolling, sticking together and decreasing clearances between single filaments when they are subjected to shocks exerted during twisting operation preparatory to weaving or knitting process or during weaving or knitting process and also to prevent excessive shrinkage during heat treatment; thus, the object of the invention to obtain a woven or knit fabric having fullness and softness can be achieved very effectively.

Degree of flatness (F);

$$L/W \geqq 4.5 \quad \text{(III)}$$

Degree of projection (T);

$$0.15 = H/L \leqq 0.4 \quad \text{(IV)}$$

Where:

L: Longest distance in cross section of coarse filament

W: Radius of greatest inscribed circle in cross section of coarse filament

H: Distance from front end B of projection to straight line connecting opposite ends A1 and A2 of longest distance L of coarse filament As for the shape of the fine filaments coexisting with the coarse filaments, shapes which are generally similar to the shape of the coarse filaments are desirable. As is true of both the coarse and the fine filaments, if a variety of cross-sectional shapes, e.g., two or three different shapes, are imparted to the filaments, woven and knit fabrics having a very good hand can be obtained.

It is required that the stress of the denier-mixed composite yarn of the invention at 10% elongation be 2.5 g/d or less. This is very effective in suppressing roughness and stiffness due to the presence of the coarse filaments constituting the denier-mixed composite yarn as well as suppressing aforesaid difference in elongation.

Controlling stress at 10% elongation be 2.5 g/d or less lowers the strength and Young's modulus of the yarn.

Therefore, the coarse filaments of the invention will not exhibit stiffness with respect to bending despite their being coarse.

That is, when a woven or knit fabric using a yarn whose stress at 10% elongation is 2.5 g/d or less is slipped by finger tips, despite the presence of coarse filaments the fabric will exhibit reduced stiffness with respect to bending; roughness and stiffness are suppressed. If the stress at 10% elongation exceeds 2.5 g/d, the strength and Young's modulus are increased, producing roughness and stiffness in the woven or knit fabric, a fact which is not desirable.

In addition, the stress at 10% elongation in the invention more or less differs according to the type of the polymer to be used or the intended hand; if the polymer to be used is polyester, it is desirable that said stress be 2.5 g/d or less, preferably 2 g/d or less, while in the case of polyamide it is desirable that said stress be 2 g/d or less, preferably 1.5 g/d or less.

The stress at 10% elongation can be controlled to 2.5 g/d or less by adjusting the draw ratio or heat treatment temperature, the control using draw ratio adjustment being more preferable.

In the invention, part of all of the coarse filaments may have thick and thin portions lengthwise thereof. That is, because of the presence of fine filaments of 1.5 denier or less and coarse filaments of 3 deniers or more which constitute the yarn, variations in finesness are produced in the direction of the cross section of the yarn, and because of the presence of thick and thin portions lengthwise of said yarn, any of the cross sections or lengthwise extending portions of the yarn is composed of single filaments or elements which differ in fineness.

If such yarn is used to form a woven or knit fabric, the surface of the fabric is rich in unevenness, giving a high degree of dry feel. Further, because of the difference between the thick and thin portions present lengthwise of the yarn, the thick and thin portions appear in a splashed pattern when said woven or knit fabric is seen through; the fabric feels refreshing.

The rate of occurrence of thick and thin portions lengthwise of the single filaments constituting the coarse filaments is 8 or more portions/m, preferably 15 or more portions/m.

It is effective to cause thick and thin portions to appear at random in cross sections and longitudinal portions.

The thick and thin portions appearing lengthwise of the yarn may be present in the fine filaments, but to soften the hand of the woven or knit fabric, it is preferable that they be present in at least part of the coarse filaments, which are stiff.

To produce such denier-mixed thick and thin yarn, it is possible to use known methods which produce thick and thin portions in the spinning or drawing process. Among other methods, one which produces thick and thin portions by controlling the draw ratio or draw temperature during draw operation is suitable since it allows the use of a relatively simple device and production of said yarn from ordinary undrawn yarn.

In the production of thick and thin yarn, it is preferable to use a partially oriented yarn in which orientation has proceeded to some degree during spinning operation of the yarn to be supplied during draw operation. That is, the thick and thin portions produced by controlling the draw ratio or draw temperature are rendered easily fusible or meltable by a heat treatment in the preparatory process before weaving or knitting or by an alkali treatment in the post-process. Therefore, to suppress such fusion and melting, it is preferable that the yarn to be supplied during draw operation be a partially oriented yarn in which orientation has proceeded to some degree.

An example of a method of producing a denier-mixed thick and thin yarn will now be decribed with reference to the drawings.

Figure 6:
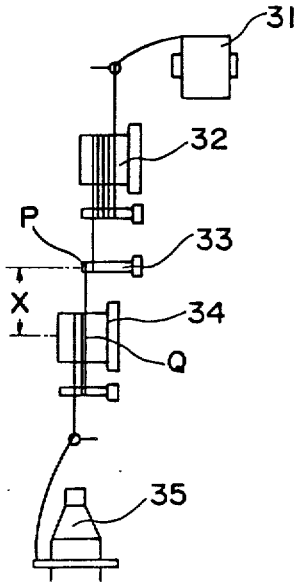
FIG. 6 is a schematic view showing an example of a draw twister used for obtaining a denier-mixed special thick and thin composite yarn according to an embodiment of the invention.

FIG. 6 is a schematic view showing an example of production on the basis of draw process. First, a supply yarn 31 such as an undrawn or partially oriented yarn prepared by winding on a single bobbin a yarn or a group of yarns differing in single filament fineness spun through a single spinneret or a plurality of spinnerets during spinning operation and formed as a denier-mixed composite yarn during spinning operation is introduced into a draw zone by a feed roller 32. A friction resistance body 33 is installed in the draw zone where the peripheral speed ratio of the supply roller 32 to a draw roller 34 also serving for heat treatment is set to a draw ratio (DR) not greater than the natural draw ratio. The supply yarn 31 is then contacted with or wound around said friction resistance body 33 and is subsequently wound on pirn 35 via the draw roller 34 also serving for heat treatment.

Now, by changing the distance (X) mm between the yarn leaving point P on the friction resistance body 33 and the yarn contact point Q on the draw roller 34 serving also for heat treatment, it is possible to control the rate of occurrence of thick and thin portions; said rate of occurrence (in portions/m) can be roughly calculated by the formula $1.2\times10^3/(DR\times X)$.

The shrinkage factor of the yarn can be adjusted by changing the temperature of the draw roller 34 also serving for heat treatment.

The presence of thick and thin portions appearing lengthwise of the yarn is ascertained by first separating coarse filaments from a denier-mixed composite yarn and drawing a thickness variation curve for the coarse filament at a chart speed of 25 cm/min using a U% Evenness Tester Model C from Keisokuki Kogyo Ltd., with a yarn speed of 8 m/min, full scale 50% and normal waveform. In this case, the number of thick portions calculated in terms of the number of peaks exceeding 10% of the base waveform per meter is measured.

Further, in a preferred embodiment of the invention, part of all of the coarse filaments are of sheath-core construction with only the core component containing a compound having an anti-static property. To impart an anti-static property to woven and knit fabrics, it is preferable that all the single filaments constituting the denier-mixed composite yarn contain an anti-static agent; however, if at least the coarse filaments which can be easily formed in sheathcore construction contain said agent, a practically sufficient anti-static property can be imparted to woven and knit fabrics. The purpose of making only the core portion of the coarse filament contain an anti-static agent is to prevent the anti-static agent from being exposed on the surface of the yarn, to improve the dyeability of the yarn after it is formed into a woven or knit fabric, to uniform the rate of weight reduction by alkaline reagent, and to suppress fading after dyeing.

Examples of anti-static agents include polyalkylene glycol, polyalkylene glycol adducts, various metal salts of organic sulfonic acid, metal salts of phosphonic acid, metal salts of carboxylic acid, and copolymers thereof with polymers to be supplied for spinning. The anti-static agent may be added to the polymer at the stage of polymerization of polymer or the spinning stage. The proportion of the anti-static agent or the polymer containing the same varies with its anti-static property. For example, when a copolymer with polyalkylene glycol and polyester serving as an anti-static agent 15 used, it is preferable that the substantial proportion of the polyalkylene glycol be within the range of 5–60 weight percent of the coarse filaments. As a result, woven and knit fabrics which are anti-static will be obtained.

Figure 7:
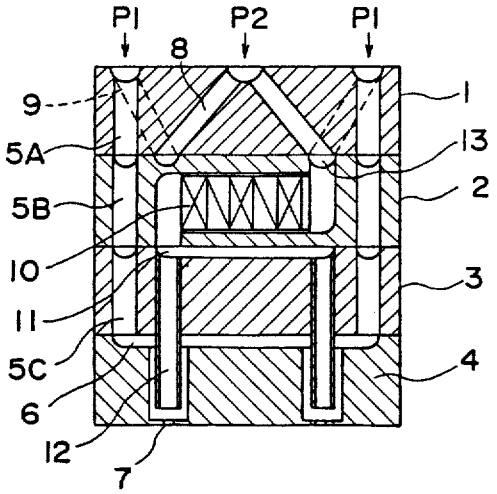
FIG. 7 is a sectional view showing part of a spinneret pack for spinning coarse filaments of sheath-core construction according to an embodiment of the invention.

An example of a method of obtaining a coarse filament constituting a yarn having an anti-static property will now be described with reference to FIG. 7 showing a schematic view of a spinneret pack.

A polymer P1 and either an anti-static agent or a polymer P2 containing such agent, which are separately melted and supplied, are fed to an introducing plate 1.

Subsequently, part of the polymer P1 is passed successively through polymer introducing holes 5A, 5B and 5C formed in the introducing plate 1, a mixing plate 2 and a needle plate 3, respectively, and then through the polymer diffusing region 6 of a spinneret 4 and is finally discharged in the form of a sheath through an orifice 7.

On the other hand, all of the anti-static agent or polymer P2 containing the same flows into a polymer introducing hole 8 in the introducing plate 1. This polymer P2 and part of the polymer P1 flowing in through a polymer introducing hole 9, while forming a composite flow in a groove 13 in the mixing plate 2, flow into a static mixer 10 embedded in the mixing plate 2 and are mixed therein. The mixed flow of the anti-static agent or polymer P2 containing the same and part of the polymer P1 passes through the polymer diffusing region 11 of the needle plate 3 and then a needle 12, and it is discharged in the form of a core through the orifice 7. Thus, a filament containing an anti-static agent in the core is obtained.

By imparting a twist in the range defined below to the denier-mixed composite yarn of the invention, it is possible to obtain woven and knit fabrics which are superior in dry feel and soft feel.

To impart dry feel to woven and knit fabrics, for example, Japanese Patent Application Laid-Open No. 115145/1983 proposes a method wherein a special non-circular cross-sectional yarn with a controlled coefficient of cross section shape is twisted 1,000–2,500 turns/m to form a woven fabric. According to this method, a fabric with considerably improved dry feel can be obtained.

However, in embodiments disclosed in said laid-open specification, dry feel is imparted to woven and knit fabrics by making the cross-sectional shape of the single filaments into a sharp non-circular cross-sectional shape, and since relatively coarse single filaments are used, though intended tightness, stiffness and dry feel can be obtained, there is a drawback that the fabric obtained exhibits a stiff hand lacking in drape and soft feel.

As result of our investigation with attention paid to the properties of single filaments to obtain a twisted yarn woven fabric superior in dry feel and soft feel, we have found that in the present invention, by specifying the number of turns of twist, it is possible to obtain such contradictory properties as tightness, stiffness and dry feel on the one hand and drape, soft feel and fullness and softness on the other hand. In the invention, it is also preferable to impart a twist such that the twist factor K is 2,000–35,000.

where:

$$K = T\sqrt{D} \quad \text{(V)}$$

T: number of turns of twist (T/m)

d: yarn fineness (in deniers)

If K exceeds 35,000, the number of twist is too high, with the result that single filaments are firmly collected together, lacking in fullness and softness and instead feeling rough. Further, since there are cases where troubles, such as yarn breakage, occur during twisting operation, it is preferable that the upper limit of K be 35,000.

On the other hand, to obtain dry feel which characterizes twisted yarn woven fabrics, a twist such that K is at least 2,000 is required; if K is less than 2,000, the features of twisted yarn fabrics would be lost, a fact which is not desirable. So long as the twist is within said range of twist factor K, a suitable number of turns of twist can be selected according to the intended hand.

For example, when a yarn of 75 d is used to obtain a twisted yarn woven fabric, the number of turns of twist may be set with a yardstick of 3,800 T/m ($K \approx 32{,}000$) for very strong twist yarn, 2,500 T/m ($K \approx 21{,}000$) for strong twist yarn or 1,000 T/m ($K \approx 8{,}600$) for medium twist yarn.

In the invention, it is also possible to obtain a yarn which imparts further emphasized dry feel and fullness and softness to woven and knit fabrics by means of false twist. As a preferred embodiment, mention may be made of a false twist yarn made from thermoplastic polymer characterized in that the following relation (VI) and (VII) are satisfied at the same time.

$$1.10 \leqq R(H) \quad \text{(VI)}$$

$$1.07 \geqq R(h) \quad \text{(VII)}$$

where

R(H): ratio $H_{max}/H_{min}$) of length of single filament of maximum length ($H_{max}$) constituting composite yarn to length of single filament to minimum length ($H_{min}$) constituting composite yarn R(h): ratio ($h_{i+1}/h_i$), to length ($h_i$) of any single filament constituting composite yarn, of length ($h_{i+1}$) of single filament greater than and closest to ($h_i$).

In other words, within a fixed length of yarn, if the ratio of the length of the single filament of maximum length ($H_{max}$) constituting the composite yarn to the length of the single filament of minimum length ($H_{min}$) constituting the composite yarn is adjusted to 1.1 or more, fullness and softness can be imparted to woven and knit fabrics and the single filaments which project beyond the surface of a woven or knit fabric because of differences in filament length take an irregular form and when the fabric is slid by finger tips, a hand similar to that of natural fiber develops. If the ratio, to the length ($h_i$) of any single filament constituting a composite yarn, of the length ($h_{i+1}$) of a single filament greater than and closest to ($h_i$) is adjusted to as relatively small as 1.07 or less, a plurality of differences in filament length will exist between the maximum filament length ($H_{max}$) and the minimum filament length ($H_{min}$). As a result, there is obtained a yarn which is covered in multilayer form such that as a result of differences in filament length which are brought about during false twist operation, the single filament whose length ($h_{i+1}$) is greater than and closest to the length ($h_i$) of any single filament covers the single filament of length ($h_i$) and the single filament whose length is greater than and closest to ($h_{i+1}$) covers the filaments of lengths ($h_i$) and ($h_{i+1}$). Such false twist yarn forms a large number of voids in woven and knit fabrics, making the latter superior in fullness and softness.

If the ratio of filament lengths is greater than the value R(h) given by the above relation, this results in the formation of neps or the occurrence of yarn breaks, while if it is less than value R(h), the difference in filament length is small, so that the resulting woven or knit fabric tends to be flat, lacking in fullness and softness or soft feel. It is required that the ratio R(H) of filament lengths be 1.1 or more, preferably within the range of 1.2–1.3, which will provide good results in respect of both passage through treating process and the hand of woven and knit fabrics.

A denier-mixed shrinkage-mixed composite yarn using a denier-mixed composite yarn of the invention as a low-shrinkage component, and a second denier-mixed shrinkage-mixed composite yarn using denier-mixed composite yarns of the invention as both a low-shrinkage component and a high-shrinkage component are preferred embodiments of the invention. The use of such denier-mixed composite yarn provides woven and knit fabrics which satisfy such contradictory properties as tightness, stiffness and dry feel on the one hand and drape, soft feel and fullness and softness on the other hand. The difference in shrinkage factor between high and low shrinkage components is 3% or more, preferably in the range of 10% to 30%.

As for the definition of difference in shrinkage factor, of a plurality of filaments which differ in shrinkage, one which exhibits the highest shrinkage factor when tested by a method to be later described is referred to as the high shrinkage component and one which exhibits the lowest shrinkage factor is referred to as the low shrinkage component, the difference between the two being what forms said definition.

There is no need whatsoever of forming the denier-mixed composite yarn from two shrinkage components alone; a third shrinkage component which is intermediate between the high and low shrinkage components may be added. Rather, such addition causes the amount of loops which form during heat treatment to differ, so that woven and knit fabrics of better hand can be obtained.

The shrinkage factor referred to herein is defined as follows: First, yarns of different shrinkage factors are classified according to shrinkage factor and individual shrinkage components are separately reeled using a measuring reel machine, and the initial length ($L_0$) is measured under a load in grams defined by the mumber of overall deniers of the shrinkage components divided by 30. Then, the yarn is immersed in boiling water at 100° C. under no load for 30 minutes and allowed to shrink in this condition. After it is dried in the air, the length ($L_1$) after shrinkage is found under the same load as before. The shrinkage factor is defined by the following formula.

Shrinkage factor:

$$S=(L_0-L_1)/L_0\times 100\%.$$

As a method of obtaining a denier-mixed shrinkage-mixed composite yarn, a method is suitably employed which comprises discharging the filaments constituting said denier-mixed composite yarn through the same spinneret or separate spinnerets, forming them into a denier-mixed composite yarn in a spinning process, creating differences in shrinkage factor in a drawn process to thereby form a shrinkage-mixed composite yarn.

Figure 9:
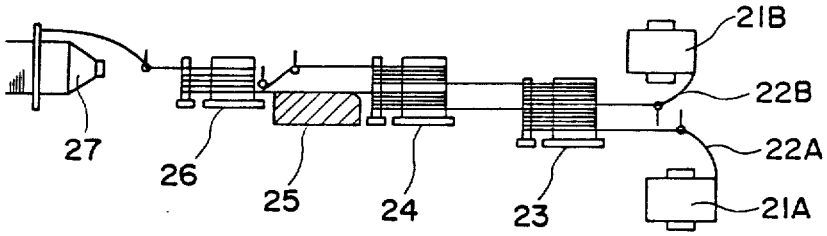
FIG. 9 is a schematic view showing an example of a draw twister used for obtaining a denier-mixed shrinkage-mixed composite yarn according to an embodiment of the invention.

The method of obtaining the shrinkage-mixed composite yarn during draw operation can be efficiently performed by using a drawing twister shown in FIG. 9. As shown, undrawn yarns 22A and 22B withdrawn from spools 21A and 21B are passed over a collect roller 23 and drawn between a heating and feeding roller 24 and a draw roller 26 in such manner that the yarn 22A alone is contacted with a hot plate 25, whereupon they are doubled (composited), the composite yarn being wound on a pirn 27.

Among suitable polymers used for forming yarns of the invention are polyester and polyamide. Polyester is suitable for improving hand by alkaline weight reduction treatment.

As for a method of obtaining the denier-mixed composite yarn of the invention, there is a method which comprises discharging the filaments constituting said composite yarn through the same spinneret or separate spinnerets, doubling them during winding, and forming them into a denier-mixed composite yarn in a spinning process. In the case of discharge through the same spinneret, by making orifice diameters and shapes suitably differ from each other it is easy to form 3 or more denier-mixed composite yarns which differ in fineness and shape.

Figure 5:
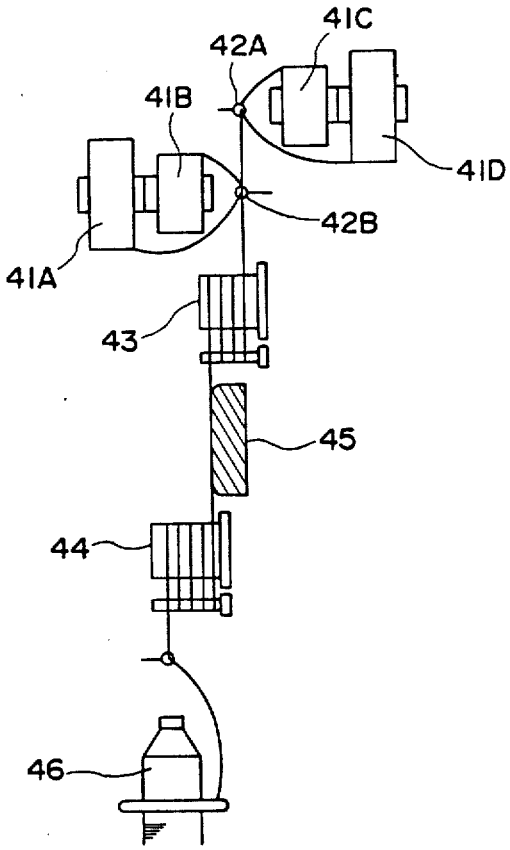
FIG. 5 is a schematic view showing an example of a draw twister used for obtaining a denier-mixed composite yarn according to the invention.

The method of obtaining a denier-mixed composite yarn during draw operation can be efficiently performed by using a draw twister shown in FIG. 5. That is, undrawn yarns withdrawn from spools 41A, 41B, 41C and 41D are collected by condenser guides 42A and 42B, drawn between a heating roller 43 and a draw roller 44 while being contacted with a hot plate 45, and would as a composite yarn pirn 46.

The elongation of single filaments in the present invention is a value obtained by separating all the single filaments constituting the composite yarn, and measuring each single filament using an Instron tensile testing machine under the conditions that the sample length is 10 cm and the pulling speed is 10 cm/min. The stress at 10% elongation is a value measured in a multi-filament state without being separated and then calculated from a strength-elongation curve.

The invention will now be described in more detail with reference to Examples.

EXAMPLES 1–4, COMPARATIVE EXAMPLES 1–4

Figure 2A:
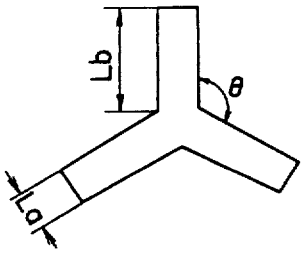
FIGS. 2(A) and 2(C) are views showing the orifice configurations of spinnerets for spinning non-circular cross-sectional filaments of FIGS. 2(B) and 2(D) according to an embodiment of the invention.
Figure 2B:
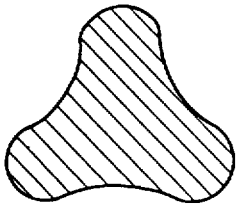

Polyethylene terephthalate containing 0.02 weight percent titanium oxide and having an intrinsic viscosity of 0.69 measured in a mixed solution medium consisting of equal weights of phenol and tetrachloroethane at 20° C. was used to form undrawn filaments A, B, C, D, E and F, 6 filaments each, whose single filament fineness was 5.5, 6.5, 8.1, 10.7, 13.3 and 16.1 deniers, respectively, and at discharge rates of 10.2, 12.1, 15.0, 19.9, 24.8 and 30.1 g/min at a spinning temperature of 285° C., and a winding speed of 1400 m/min (const.) using a device having a configuration shown in FIG. 2(A) wherein a spinneret of triangular cross section having orifices, 6 holes×2 groups=12 holes, in the form of slits with La=0.12 mm and Lb=0.30 mm and an angle $\theta$ (formed between slits)=120° was attached o a spindle, said undrawn filaments being wound, 6 filaments each and in 2 hanks, to form undrawn filaments having a cross-sectional shape shown in FIG. 2(B).

On the othe hand, a spinneret for round cross-sectional yarn having orifices of 0.2 mm in diameter, 12 holes×2 groups=24 holes, was attached to another spindle, and undrawn filaments a, b, c, d and e whose single filament fineness was 1.6, 2.2, 2.9, 3.4 and 4.2 deniers, respectively, were wound, 12 filaments each in two hanks, at a discharge rate of 5.8, 7.8, 10.7, 12.6 and 15.5 g/min at a spinning temperature of 290° C. and a winding speed of 1400 m/min (constant).

These 11 kinds of undrawn yarns were combined in various ways and doubled as shown in Table 1, and using a draw twister shown in FIG. 5, they were composited and drawn at a draw ratio of 2.6, a draw temperature of 85° C. and a heat treatment temperature of 140° C., using a draw twister shown in FIG. 5.

Composite yarns thus obtained were passed through warping and sizing processes and then woven into fabrics of plain weave which were then subjected to relax scouring, 25% weight reduction, presetting, dyeing, and final setting, and the hand of the woven fabrics were assessed in comparison with that of a fabric of plain weave using a conventional triangular cross-sectional yarn.

The assessment of hand was made by sensory test from three viewpoints, fullness and softness, soft feel and dry feel, and the results were rated in three classes using the marks ◎ , ○ and X.

◎: very good as compared with the triangular cross-sectional yarn used as the standard for assesment (single filament fineness which was constant, 1.5 deniers, 75 deniers/48 filaments).

○: good as compared with said triangular cross-sectional yarn.

X: equal or inferior as compared with said triangular cross-sectional yarn.

Further, the capacity for passage through process assessed on the basis of production of fluffs by contact with guides during warping and sizing and the frequency of stoppage of the warping or sizing machine due to yarn breaks was rated in three classes using the marks ◎ , ○ and X.

◎: substantially the same capacity for passage through process as that for the conventional yarn.

○: the frequency of stoppage of warping or sizing machine is somewhat higher than in the case of the conventional yarn but post-process is somehow possible on an industrial level.

X: the capacity for passage through post-process is extremely low, so that post-process on an industrial level is far from possible.

TABLE 1

| | Total | Proportion of coarse | Proportion of fine | Distribution of single filament |
|---|---|---|---|---|

TABLE 1-continued

| Test No. | Combination of composite yarns | fineness (in deniers) | Total number of filaments | filament (in weight percent) | filament (in weight percent) | elongation of filament group (upper row: filament group, lower row: elongation %) | | |
|---|---|---|---|---|---|---|---|---|
| Example 1 | A + C + E + a + d | 85.0 | 42 | 57.9 | 27.3 | A<br>35.6~44.2 | C<br>47.7~54.8 | E<br>60.1~67.1 |
| Example 2 | A + D + a + c + e | 77.5 | 48 | 31.7 | 26.9 | A<br>35.6~44.2 | D<br>52.9~61.3 | a<br>10.6~18.6 |
| Example 3 | A + D + F + 2b | 93.8 | 42 | 65.9 | 20.7 | A<br>35.6~44.2 | D<br>52.9~61.3 | F<br>64.9~72.4 |
| Comparative 1 | 2B + b + 2d | 71.2 | 48 | 0 | 57.9 | 2B<br>41.6~51.2 | b<br>16.5~22.4 | 2d<br>25.3~31.9 |
| Example 4 | A + E + a + 2c | 77.5 | 48 | 39.5 | 44.3 | A<br>35.6~44.2 | E<br>60.1~67.1 | a<br>10.6~18.6 |
| Comparative 2 | 2B + C + b + 2e | 96.6 | 54 | 19.3 | 9.9 | 2B<br>41.6~51.2 | C<br>47.7~54.8 | b<br>16.5~22.4 |
| Comparative 3 | A + C + D + 2e | 94.2 | 42 | 45.9 | 0 | A<br>35.6~44.2 | C<br>47.7~54.8 | D<br>52.9~61.3 |
| Comparative 4 | D + F + 2a + c | 89.4 | 48 | 69.1 | 30.9 | D<br>52.9~61.3 | F<br>64.9~72.4 | 2a<br>10.6~18.6 |
| Example 5 | D + F + 2f + g | 93.6 | 48 | 66.0 | 34.0 | D<br>52.9~61.3 | F<br>64.9~72.4 | 2f<br>18.8~26.0 |

| Test No. | Distribution of single filament elongation of filament group (upper row: filament group, lower row: elongation %) | | $E_{max} - E_{min}$ (%) | Maximum Value of $E_{i+1} - E_i$ (%) | Stress at 10% elongation (g/d) | Assessment: Capacity for passage through post-process | Assessment: Hand |
|---|---|---|---|---|---|---|---|
| Example 1 | a<br>10.6~18.6 | d<br>25.3~31.9 | 56.5 | 6.7 | 1.6 | ○ | ○ |
| Example 2 | c<br>19.9~28.1 | e<br>29.4~38.8 | 50.7 | 8.7 | 2.1 | ○ | ○ |
| Example 3 | 2b<br>15.8~23.3 | —<br>— | 56.6 | 12.3 | 0.8 | ○ | ◎ |
| Comparative 1 | —<br>— | —<br>— | 34.7 | 9.7 | 2.8 | ◎ | X |
| Example 4 | 2c<br>19.9~28.1 | —<br>— | 56.5 | 15.9 | 1.8 | ○ | ◎ |
| Comparative 2 | 2e<br>29.4~38.8 | —<br>— | 38.3 | 7.0 | 1.7 | ◎ | X |
| Comparative 3 | 2e<br>29.4~38.8 | —<br>— | 31.9 | 3.5 | 2.4 | ◎ | X |
| Comparative 4 | c<br>19.9~28.1 | —<br>— | 61.8 | 24.8 | 0.8 | X | ◎ |
| Example 5 | g<br>28.6~34.8 | —<br>— | 53.6 | 18.1 | 0.6 | ○ | ◎ |

Comparative Examples 1 and 2 show the case where the proportion of coarse filament having a fineness of 3 deniers or more is too low, each being lacking in dry feel. Comparative Example 3 shows an example in which there is no fine filament whose fineness is 1.5 denier or less, in which case the hand of a woven fabric is too rough and stiff, lacking in soft feel. Comparative Example 4 shows the case where the maximum value of difference in elongation between adjacent filaments is as extremely high as 24.8% and the capacity for passage through process at the time of post-treatment is very low.

EXAMPLE 5

Of the conditions for spinning round cross-sectional yarns a and c used in Comparative Example 4, the one of winding speed was lowered to 1200 m/min, and undrawn filaments f and g were formed whose single filament fineness was 1.8 and 3.3 deniers, respectively.

Subsequently, these undrawn filaments f and g and the undrawn filaments D and F were composited and drawn under the same conditions, used in comparative Example 4, the results being shown in Table 1.

In this case, the effect of lowering the winding speed increased the elongation of the fine filaments and the difference in elongation of adjacent filaments was 18.1%, a decrease of about 7% over Comparative Example 4. As a result, the capacity for passage through process in post-treatment improved.

EXAMPLE 6

Using a device in which a spinneret having various forms and sizes of orifices shown in FIG. 3 and Table 2, a total of 48 holes (orifice i: 8 holes, orifice j: 8 holes, orifice k: 8 holes, orifice l: 8 holes, orifice m: 4 holes, orifice n: 4 holes, orifice o: 4 holes: orifice p: 4 holes) was attached to a spindle, the polyetheylene terephthalate used in Example 1 was spun at a spinning temperature of 295° C., a total discharge rate of 35.6 g/min, and a winding speed of 1400 m/min, to obtain undrawn yarns of 229 deniers/48 filaments.

TABLE 2

| Orifice | Size La(mm) | Lb(mm) | Lc(mm) | Ld(mm) |
|---|---|---|---|---|
| i | 0.07 | 0.25 | 0.4 | — |
| j | " | " | 0.6 | — |
| k | " | 0.3 | " | — |
| l | " | " | 0.8 | — |
| m | 0.08 | " | 0.5 | — |
| n | " | 0.4 | 0.7 | — |
| o | " | — | " | 0.4 |
| p | " | — | 1.0 | 0.5 |

Subsequently, each undrawn yarn was singly drawn under conditions: a draw temperature of 85° C., a heat treatment temperature of 140° C., and a draw ratio of 2.6. The drawn yarn was separated and the single filament fineness and elongation of all filaments were measured while the cross-sectional shapes were examined.

The results are shown in Table 3. In Table 3, filaments spun through orifices i, j, k, etc. are expressed as filament groups i, j, k, etc. and correspondence between orifice No. and filament groups is made.

TABLE 3

| Properties of filaments constituting composite yarn | | | | Proportion | Proportion | | | |
|---|---|---|---|---|---|---|---|---|
| Filament group | Number of filaments | Single filament fineness (in deniers) | Distribution of single filament fineness (%) | of course filament (weight percent) | of fine filament (weight percent) | $E_{max} - E_{min}$ (%) | Maximum values of $E_{i+1} - E_i$ (%) | Stress at 10% elongation (g/d) |
| i | 8 | 0.7 | 32.5~40.1 | 35.6 | 30.0 | 46.7 | 3.6 | 1.8 |
| j | 8 | 1.2 | 40.5~47.4 | | | | | |
| k | 8 | 1.4 | 49.4~54.1 | | | | | |
| l | 8 | 1.6 | 55.4~58.8 | | | | | |
| m | 4 | 1.9 | 60.2~63.2 | | | | | |
| n | 4 | 2.4 | 63.9~65.3 | | | | | |
| o | 4 | 3.2 | 68.9~72.2 | | | | | |
| p | 4 | 4.6 | 73.7~79.2 | | | | | |

As in Example 1, woven fabrics were made and assessed. The hand was very good, rated ◎, and the capacity for passage through post-process was rated ○.

EXAMPLES 7-10

Using the polyethylene terephthalate used in Example 1 and using two kinds of spinnerets having 6 holes, 2 groups (a total of 12 holes), with W-shaped and crisscross cross sections, respectively, and making changes to a spinning temperature of 290° C. and discharge rates of 10.3 and 20.0 g/min, with the winding speed being constant at 1400 m/min, W-shaped and crisscross cross-sectional undrawn filaments $X_1$ (crisscross cross-sectional filaments: single filament fineness, 5.8 deniers), $X_2$ (crisscross cross-sectional filaments: single filament fineness, 10.8 deniers), $Y_1$ (W-shaped cross-sectional filaments: single filament fineness, 5.8 deniers) and $Y_2$ (W-shaped cross-sectional filaments: single filament fineness, 10.8 deniers) were wound, 6 filaments each and in 2 hanks.

On the other hand, using a spinneret of round cross section with a hole diameter of 0.2 mm, 12 holes, 2 groups (a total of 24 holes), and making changes to a spinning temperature of 290° C. and discharge rates of 5.8, 10.8 g/min and 15.7 g/min, with the winding speed being constant at 1400 m/min, undrawn filaments $Z_1$ (single filament fineness, 1.6 denier), $Z_2$ (single filament fineness, 2.9 deniers), and $Z_3$ (single filament fineness, 4.2 deniers) were wound, 12 filaments each and in 2 hanks.

The undrawn filaments thus obtained were doubled between W-shaped or crisscross cross-sectional filaments themselves, between W-shaped and crisscross cross-sectional filaments and between three kinds of round cross-sectional filaments different in single filament fineness whithin the range of mixing proportions defined by the invention during the draw operation. Using a draw twister, the same were then drawn and composited at a draw ratio of 2.6 and a draw roller temperature of 85° C. by being contacted with a hot plate heated to 140° C. The results are shown in Table 4.

The composite yarns composed of coarse or relatively coarse W-shaped or crisscross or W-shaped and crisscross cross-sectional filaments were passed through a series of preparatory processes including warping and sizing and then woven into fabrics of plain weave, the fabrics being then subjected to a series of post-processes including scouring, weight reduction treatment and dyeing. The hand of the woven fabrics thus obtained was sensorially generally assessed with respect to dry feel, fullness and softness, tightness, stiffness or soft feel, as in Example 1. The results are shown in Table 4. As for the capacity for passage through process at preparatory stage for during weaving, it was possible to handle the yarns without any problem, as compared with the conventional yarns.

TABLE 4

| Test No. | Combination of composite yarns | Total fineness (in deniers) | Total number of filaments | Proportion of coarse filament (in weight percent) | Proportion of fine filament (in weight percent) | Distribution of single filament elongation of filament group (upper row: filament group, lower row: elongation %) | |
|---|---|---|---|---|---|---|---|
| Example 7 | $X_1 + X_2 + Z_1 + Z_2 + Z_3$ | 77.9 | 48 | 32.0 | 26.2 | $X_1$<br>36.2~43.1 | $X_2$<br>53.6~64.2 |
| Example 8 | $Y_1 + Y_2 + Z_1 + Z_2 + Z_3$ | 77.9 | 48 | 32.0 | 26.2 | $Y_1$<br>38.6~46.3 | $Y_2$<br>55.1~66.3 |
| Example 9 | $X_1 + Y_2 + Z_1 + Z_2 + Z_3$ | 77.9 | 48 | 32.0 | 26.2 | $X_1$<br>36.2~43.1 | $Y_2$<br>55.1~66.3 |
| Example 10 | $Y_1 + X_2 + Z_1 + Z_2 + Z_3$ | 77.9 | 48 | 32.0 | 26.2 | $Y_1$<br>38.6~46.3 | $X_2$<br>53.6~64.2 |

| Test No. | Distribution of single filament elongation of filament group (upper row: filament group, lower row: elongation %) | | | $E_{max} - E_{min}$ (%) | Maximum value of $E_{i+1} - E_i$ (%) | Stress at 10% elongation (g/d) | Assessment | |
|---|---|---|---|---|---|---|---|---|
| | | | | | | | Capacity for passage through post-process | Hand |
| Example 7 | $Z_1$<br>10.6~18.6 | $Z_2$<br>19.9~28.1 | $Z_3$<br>29.4~38.8 | 53.6 | 10.5 | 1.8 | ◎ | ◎ |
| Example 8 | $Z_1$<br>10.6~18.6 | $Z_2$<br>19.9~28.1 | $Z_3$<br>29.4~38.8 | 55.7 | 8.8 | 1.7 | ◎ | ○ |
| Example 9 | $Z_1$<br>10.6~18.6 | $Z_2$<br>19.9~28.1 | $Z_3$<br>29.4~38.8 | 55.7 | 12.0 | 1.9 | ○ | ◎ |

TABLE 4-continued

| | | | | | | | | |
|---|---|---|---|---|---|---|---|---|
| Example 10 | $Z_1$ 10.6~18.6 | $Z_2$ 19.9~28.1 | $Z_3$ 29.4~38.8 | 53.6 | 7.3 | 1.9 | ⊚ | ○ |

EXAMPLE 11

Figure 2C:
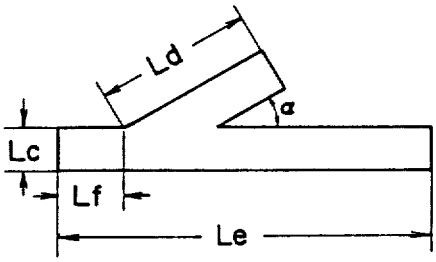
Figure 2D:
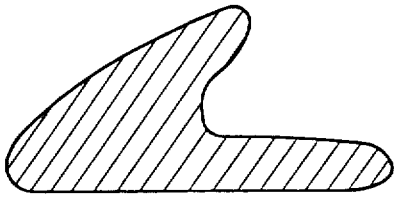
Figure 3A:
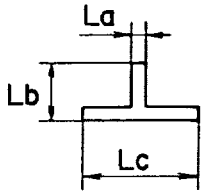
FIGS. 3(A) through 3(H) are schematic views showing the orifice configurations of spinnerets used in Example 6 to be later described.
Figure 3B:
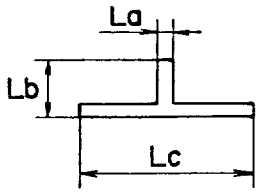
Figure 3C:
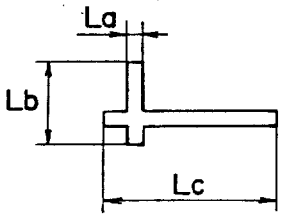
Figure 3D:
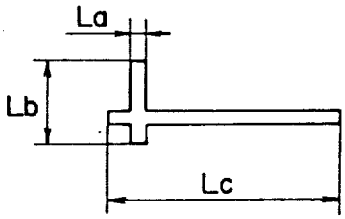
Figure 3E:
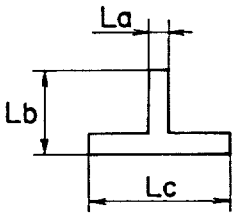
Figure 3F:
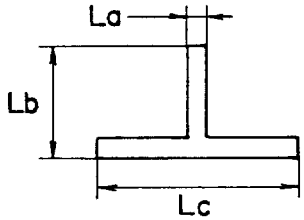
Figure 3G:
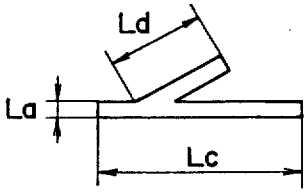
Figure 3H:
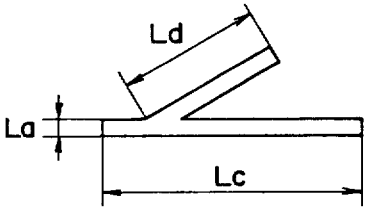
Figure 4A:
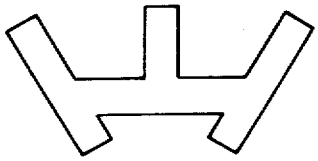
FIGS. 4(A) and 4(B) are views showing the orifice configurations of spinnerets for spinning W-shaped and crisscross cross-sectional filaments having forms of the non-circular cross section of a filament according to an embodiment of the invention.
Figure 4B:
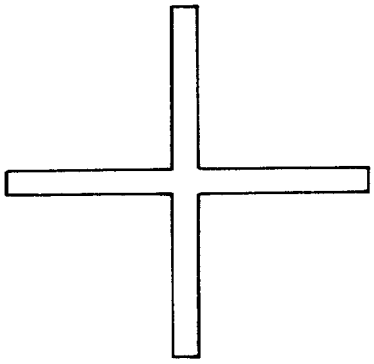

Polyethylene terephthalate containing 0.02 weight percent titanium oxide and having an intrinsic viscosity of 0.65 was spun using a spinneret having the configuration shown in FIG. 2(C) with 12 orifices of Lc=Lf: 0.08 mm, Ld: 0.05 mm, Le: 1.1 mm and $\alpha$: 30 degrees, and the configuration of FIG. 2(A) with 36 orifices of La: 0.08 mm, Lb: 0.22 mm, $\theta$: 120°, totaling 48 orifices, under the conditions of a spinning temperature of 295° C. and a discharge rate of 37.5 g/min, thus producing filaments having the cross-sectional shapes shown in FIGS. 2(B) and 2(D). A total of 48 filaments were collected to form a single yarn which was then wound on a bobbin at a winding speed of 2500 m/min.

The undrawn yarn thus obtained was drawn at a draw ratio of 1.6 using the device shown in FIG. 6 with X adjusted to 50 mm, thereby producing a denier-mixed special thick and thin composite yarn whose frequency of thick portions was 16/m. This yarn was a denier-mixed special thick and thin composite yarn of 85D/48F in which the flat cross-sectional filament (coarse filament) was of 5 deniers, its proportion was 70 weight percent, and the triangular cross-sectional filament (fine filament) was of 0.7 denier and its proportion was 30 weight percent. E(max)−E(min) of the special thick and thin composite yarn thus obtained was 38.4%, the maximum value of $E_{i+1}-E_i$ was 13.6%, and the stress at 10% elongation was 0.48 g/d.

Using this denier-mixed special thick and thin composite yarn as warp and weft, a woven fabric of plain weave was produced. It was subjected successively to relax scouring, 25% weight reduction, presetting, dyeing and final setting. The fabric thus obtained was assessed and was found to be a woven fabric of silk-like hand, superior in dry feel, fullness and softness and luster.

EXAMPLE 12

The same polyethylene terephthalate as in Example 1 was spun and drawn using the same spinneret as in Example 6 under the same conditions as in Example 6.

This denier-mixed composite yarn was twisted using an Italian twisting machine to produce a 300 T/m (K≈2,760) S-direction soft twist yarn, 1,000 T/m (K≈9,220) S- and z-direaction medium twist yarns, 2,500 T/m (K≈23,000) S- and Z-direction hard twist yarns, and a 3,900 T/m (K≈36,000) S-direction ultra-hard twist yarn, and these yarns were then heat treated at 85° C.

Using these yarns, there were produced (1) crepe de chine in which 300 T/m S-twist soft twist yarns were arranged in warp and 2,500 T/m S- and Z-twist yarns were alternately arranged in weft and (2) voile in which 1,000 T/m S- and Z-twist yarns were alternately arranged in both warp and weft. These fabrics were then subjected to a series of post-processes including scouring, alkaline weight reduction and dyeing. The fabric thus obtained was assessed and was found to be a woven fabric of silklike hand, superior in dry feel, softress and luster.

The ultra-hard twist yarn with the number of turns of twist of 3,900 T/m suffered fluffs and yarn breaks frequently occurring during twisting operation, so that it could not be assessed as a product.

EXAMPLE 13

Spinning and drawing were performed under the same conditions as in Example 6, producing drawn yarns.

These drawn yarns were false-twisted using a false twisting machine under the conditions of false twist temperature: 195° C., number of turns of twist: 2810 T/m, overfeed factor: 2%.

The false twist yarns were each separated into filaments and the fineness and elongation of all filaments were measured while ascertaining the cross-sectional shape. The results are shown in Table 5.

| Example | 13 | | | |
|---|---|---|---|---|
| Filament group | i | j | k | l |
| Number of single filaments | 8 | Same as at left | Same as at left | Same as at left |
| Single filament fineness | 0.7 De | 1.2 De | 1.4 De | 1.6 De |
| Distribution of elongation of single filaments | 30.2~34.1 | 33.7~40.1 | 41.7~45.9 | 47.1~49.9 |
| Distribution of ratio of lengths of single filaments, R (h) | 1.00~1.02 | Same as at left | Same as at left | Same as at left |
| Example | 13 | | | |
| Filament group | m | n | o | p |
| Number of single filaments | 4 | Same as at left | Same as at left | Same as at left |
| Single filament fineness | 1.9 De | 2.4 De | 3.2 De | 4.6 De |
| Distribution of elongation of single filaments | 51.1~54.0 | 54.3~55.5 | 58.6~61.4 | 62.6~67.3 |
| Distribution of ratio of lengths of single filaments, R (h) | 1.00~1.02 | Same as at left | Same as at left | Same as at left |

The distribution R(h) of ratio of filament lengths in the table is the distribution of ratio of lengths of filaments in a single shape, and R(h) for all false twist yarns was 1.00–1.02.

The ratio R(H) of filament lengths was 1.24, and the proportion of coarse filament was 35.6 weight percent while the proportion of fine filament was 30.0 weight percent.

The false twist yarns having these shapes and filament fineness were passed through a series of preparatory processes including warping and sizing and then woven into fabrics of plain weave. The hand of the woven fabrics was assessed with respect to dry feel, fullness and softness, tightness, stiffness, or softness and was found to be very good. As for the capacity for passage through process at preparatory stage or during weaving, the yarns could be handled without any problem as compared with the conventional yarns.

EXAMPLE 14

A device was used in which spinneret for filaments of triangular cross section of the shape shown in FIG.

Figure 8A:
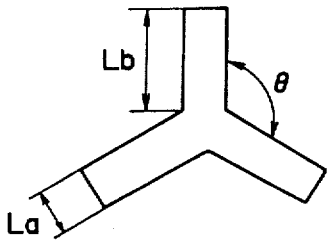
FIG. 8(A) and 8(B) are sectional views of the orifice configuration of a spinneret used in Example 14 to be later described and a single filament spun using said spinneret.
Figure 8B:
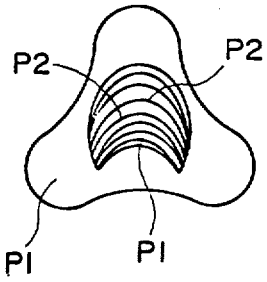

8(A) having 12 orifices with La: 0.12 mm, Lb: 0.30 mm and the angle $\theta$ formed between slits being 120°, and a second spinneret for filaments of round cross section having 30 orifices with a diameter of 0.2 mm were attached to separate spindles. The spinneret pack shown in FIG. 7 was used for the spinneret for filaments of triangular cross section, and polyethylene terephthalate serving as the polymer P1 forming the sheath and part of the core of a single filament was fed at a discharge rate of 21 g/min while polyethylene terephthalate mixed with 20 weight percent polyethylene glycol (with a molecular weight of 5000) serving as the polymer P2 forming the core was fed at a discharge rate of 3.5 g/min; thus, single filament of sheath-core construction shown in FIG. 8(B) having a triangular cross section was spun at a spinning temperature of 285° C.

On the other hand, the spinneret for filaments of round cross section was fed with the same polyethylene terephthalate as that forming the sheath and part of the core of triangular cross section under the conditions of a spinning temperature of 295° C. and a discharge rate of 9.7 g/min, thereby spinning filaments whose cross section was round and which was composed solely of polyethylene terephthalate.

These two kinds of filaments of different cross-sectional shapes were doubled on a winding roller and wound on a bobbin at a winding speed of 1,400 m/min.

The undrawn yarn thus wound was drawn with draw ratio: 2.6, draw temperature: 85° C., and heat treatment temperature: 165° C., thereby providing a drawn yarn of 85D/42F composed of the triangular cross-sectional filaments (mixing proportion: 70%) whose single filament fineness was 0.8 denier and the round cross-sectional filaments (mixing proportion: 30%) whose single filament fineness was 0.8 denier.

The Emax-Emin of this drawn yarn was 32.6%, the maximum value of Ei+1−Ei was 14.3%, and the stress at 10% elongation was 1.6 g/d. Further, the anti-staic property was good, exhibiting a voltage of 900 V and a half-life of 5 seconds.

The anti-static property of the ordinary triangular cross-sectional yarn used for comparison exhibited a voltage of 3,000 V and a half-life of 600 seconds.

The denier-mixed composite yarn thus obtained was woven into a fabric of plain weave, and the fabric was subjected to a series of post-processes and then its hand was compared with that of the fabric of plain weave of ordinary triangular cross-sectional yarn; it was found that fabric of the invention has superior dry feel and fullness and softness.

Further, this drawn yarn was knit into tubular knit fabrics, and the fabrics were subjected to alkaline weight reduction by immersing them at 70° C. in an aqueous solution containing 20% sodium hydroxide with the immersion time suitably adjusted so that alkaline weight reduction factor was 5, 10, 15, 20, 25, 30, 35 and 40%, respectively.

A visual inspection of these tubular knit fabrics by microscope showed that the core component was not exposed on the surface of the single filament even when the tubular knit fabric of sheath-core construction whose single filament was composed of the polymers P1 and P2 had a weight reduction factor of 35%. When this drawn yarn was false twisted at 3,350 T/m and a heat treatment temperature of 195° C., it was found that the yarn of sheath-core construction whose single filament was composed of the polymers P1 and P2 suffered a greatly reduced number of breaks as the tension was stable during false twist operation.

EXAMPLE 15

Using the same spinneret as that used in Example 6, the same polyethylene terephthalate as that used in Example 1 was spun at a spinning temperature of 295° C., a discharge rate of 35.0 g/min and a winding speed of 1400 m/min, the resulting filaments being collected into groups each having the same number of filaments of the same cross-sectional shape, providing two groups of filaments, each group having 24 filaments, and these filaments were wound on two groups of bobbins.

The undrawn yarns obtained were drawn using the device shown in FIG. 9 under the conditions of draw ratio: 2.6 and draw temperature: 85° C. in such a manner that only the filaments composed of the low-shrinkage component was purposely contacted with a hot plate heated to 165° C. but the filaments composed of the high-shrinkage component was kept away from the hot plate by means of a guide, and two groups of different shrinkage factors were doubled to provide a flat yarn.

The difference in shrinkage factor was found from the respective shrinkage factors of the high- and low-shrinkage components sampled in advance of doubling and compositing. This denier-mixed shrinkage-mixed composite yarn was woven into a fabric of plain weave, and the fabric was subjected to a series of post-processes. The hand of the fabric was compared with that of a fabric of plain weave of ordinary triangular cross-sectional yarn. The results are shown in Table 6.

TABLE 6

| | | |
|---|---|---|
| Total fineness (Den) | | 87.6 |
| Total number of filaments | | 48 |
| Proportion of coarse filament (%) | | 35.6 |
| Proportion of fine filament (%) | | 30.1 |
| Shrinkage factor (%) | High-shrinkage filament | 30.6 |
| | Low-shrinkage filament | 5.2 |
| Difference in shrinkage factor (%) | | 25.4 |
| $E_{max} - E_{min}$ (%) | | 48.3 |
| Maximum value of $E_{i+1} - E_i$ (%) | | 3.6 |
| Stress at 10% elongation (g/d) | | 1.7 |
| Assessment | Capacity for passage through process | ◎ |
| | Hand | ◎ |

Assessment in Table
◎: Very good as compared with the triangular cross section used as the standard for assessment in measurement.

What is claimed is:

1. A denier-mixed composite yarn containing 20 weight percent or more coarse filaments whose single filament fineness is 3 deniers or more and 5 weight percent or more fine filaments whose single filament fineness is 1.5 denier or less, characterized in that part or all of said coarse filaments are of non-circular cross-section, the stress of said composite yarn at 10% elongation is 2.5 g/d or less, and the following relations (I) and (II) are satisfied:

$$E_{max} - E_{min} \geqq 20(\%) \quad \text{(I)}$$

$$E_{i+1} - E_i \geqq 20(\%) \quad \text{(II)}$$

Where $E_{max}$ is the elongation (%) of the maximum elongation single filament constituting the composite yarn, $E_{min}$ the elongation (%) of the single filament exhibiting minimum elongation, $E_i$ the elongation (%)

of any single filament (excluding the maximum elongation single filament) constituting the composite yarn, and $E_{i+1}$ the elongation (%) of the single filament which exhibits elongation greater than and closest to $E_i$.

2. A denier-mixed composite yarn as set forth in claim 1, wherein $E_{i+i}-E_i$ is 15 or less.

3. A denier-mixed composite yarn as set forth in claim 1, wherein the filaments of non-circular cross section are filaments of crisscross cross section.

4. A denier-mixed composite yarn as set forth in claim 1, wherein each filament of non-circular cross section is of rotation-asymmetric cross section having a base and a projection and has a degree of flatness and a degree of projection satisfying the following relations (III) and (IV)

degree of flatness (F):

$$L/W \geqq 4.5 \quad \text{(III)}$$

degree of projection (T):

$$0.15 = H/L \leqq 0.4 \quad \text{(IV)}$$

where:

L: longest distance in cross section of coarse filament, W: radius of greatest inscribed circle in cross section of coarse filament, H: distance from front end B of projection to straight line connecting opposite ends A1 and A2 of longest distance L of coarse filament.

5. A denier-mixed composite yarn as set forth in claim 1, wherein the filaments of non-circular cross section are of W-shaped cross section.

6. A denier-mixed special thick and thin composite yarn containing 20 weight percent or more coarse filaments whose single filament fineness is 3 deniers or more and 5 weight percent or more fine filaments whose single filament fineness is 1.5 denier or less, at least part of said coarse filaments having thick and thin portions lengthwise thereof, characterized in that part or all of said coarse filaments are of non-circular cross-section, the stress of said composite yarn at 10% elongation is 2.5 g/d or less, and the following relations (I) and (II) are satisfied:

$$E_{max}-E_{min} \geqq 20(\%) \quad \text{(I)}$$

$$E_{i+i}-E_i \leqq 20(\%) \quad \text{(II)}$$

where $E_{max}$ is the elongation (%) of the maximum elongation single filament constituting the composite yarn, $E_{min}$ the elongation (%) of the single filament exhibiting minimum elongation, $E_i$ the elongation (%) of any single filament (excluding the maximum elongation single filament) constituting the composite yarn, and $E_{i+1}$ the elongation (%) of the single filament which exhibits elongation greater than and closest to $E_i$.

7. A denier-mixed special thick and thin composite yarn as set forth in claim 6, wherein each filament of non-circular cross section is a filament of special non-circular cross section with an rotation-asymmetric cross section having a base and a projection and has a degree of flatness and a degree of projection satisfying the following relations (III) and (IV)

degree of flatness (F):

$$L/W \geqq 4.5 \quad \text{(III)}$$

degree of projection (T):

$$0.15 = H/L \leqq 0.4 \quad \text{(IV)}$$

where:

L: longest distance in cross section of coarse filament, W: radius of greatest inscribed circle in cross section of coarse filament, H: distance from front end of projection to straight line connecting opposite ends of longest distance of coarse filament.

8. A denier-mixed composite yarn containing 20 weight percent or more coarse filaments whose single filament fineness is 3 deniers or more and 5 weight percent or more fine filaments whose single filament fineness is 1.5 denier or less, characterized in that part or all of said coarse filaments are of non-circular cross-section, the stress of said composite yarn at 10% elongation is 2.5 g/d or less, at least all of coarse filaments are of sheath-core construction, the core component alone contains a compound having anti-static property, and the following relations (I) and (II) are satisfied:

$$E_{max}-E_{min} \geqq 20(\%) \quad \text{(I)}$$

$$E_{i+1}-E_i \leqq 20(\%) \quad \text{(II)}$$

where $E_{max}$ is the elongation (%) of the maximum elongation single filament constituting the composite yarn, $E_{min}$ the elongation (%) of the single filament exhibiting minimum elongation, $E_i$ the elongation (%) of any single filament (excluding the maximum elongation single filament) constituting the composite yarn, and $E_{i+1}$ the elongation (%) of the single filament which exhibits elongation greater than and closest to $E_i$.

9. A denier-mixed composite yarn as set forth in claim 8, wherein each filament of non-circular cross section is of rotation-asymmetric cross section having a base and a projection and has a degree of flatness and a degree of projection satisfying the following relations (III) and (IV)

degree of flatness (F):

$$L/W \geqq 4.5 \quad \text{(III)}$$

degree of projection (T):

$$0.15 = H/L \leqq 0.4 \quad \text{(IV)}$$

where:

L: longest distance in cross section of coarse filament, W: radius of greatest inscribed circle in cross section of coarse filament, H: distance from front end of projecting to straight line connecting opposite ends of longest distance of coarse filament.

10. A denier-mixed composite yarn for woven fabrics using twisted yarns, said denier-mixed composite yarn being obtained by twisting a denier-mixed composite yarn containing 20 weight percent or more coarse filaments whose single filament fineness is 3 deniers or more and 5 weight percent or more fine filaments whose single filament fineness is 1.5 denier or less, characterized in that part or all of said coarse filaments are of non-circular cross-section, the stress of said composite yarn at 10% elongation is 2.5 g/d or less, the following relations (I) and (II) are satisfied, and said composite yarn has a twist such that its twist constant (K) defined by the following relation (V) is 2000–35000:

$$E_{max}-E_{min}\geqq 20(\%) \quad \text{(I)}$$

$$E_{i+1}-E_i\leqq 20(\%) \quad \text{(II)}$$

where $E_{max}$ is the elongation (%) of the maximum elongation single filament constituting the composite yarn, $E_{min}$ the elongation (%) of the single filament exhibiting minimum elongation, $E_i$ the elongation (%) of any single filament (excluding the maximum elongation single filament) constituting the composite yarn, and $E_{i+1}$ the elongation (%) of the single filament which exhibits elongation greater than and closest to $E_i$, $$K=T\sqrt{D} \quad \text{(V)}$$

where

T: the number of turns of twist (T/M)

D: the yarn fineness (in deniers).

11. A denier-mixed composite yarn for woven fabrics using twisted yarns as set forth in claim 10, wherein each filament of non-circular cross section is a filament of special non-circular cross section with a rotation-asymmetric cross section having a base and a projection and has a degree of flatness and a degree of projection satisfying the following relations (III) and (IV)

degree of flatness (F):

$$L/W\geqq 4.5 \quad \text{(III)}$$

degree of projection (T):

$$0.15=H/L\leqq 0.4 \quad \text{(IV)}$$

where:

L: longest distance in cross section of coarse filament, W: radius of greatest inscribed circle in cross section of coarse filament, H: distance from front end of projection to straight line connecting opposite ends of longest distance of coarse filament.

12. A false twist yarn obtained by false twisting a denier-mixed composite yarn containing 20 weight percent or more coarse filaments whose single filament fineness is 3 deniers or more and 5 weight percent or more fine filaments whose single filament fineness is 1.5 denier or less, characterized in that part or all of said coarse filaments are of non-circular cross-section, the stress of said composite yarn at 10% elongation is 2.5 g/d or less, the following relations (I) and (II) are satisfied, and at the same time the following relations (VI) and (VII) are also satisfied:

$$E_{max}-E_{min}\geqq 20(\%) \quad \text{(I)}$$

$$E_{i+1}-E_i\leqq 20(\%) \quad \text{(II)}$$

where $E_{max}$ is the elongation (%) of the maximum elongation single filament constituting the composite yarn, $E_{min}$ the elongation (%) of the single filament exhibiting minimum elongation, $E_i$ the elongation (%) of any single filament (excluding the maximum elongation single filament) constituting the composite yarn, and $E_{i+1}$ the elongation (%) of the single filament which exhibits elongation greater than and closest to $E_i$, $$1.10\leqq R(H) \quad \text{(VI)}$$

$$1.07\geqq R(h) \quad \text{(VII)}$$

where R (H) is the ratio ($H_{max}/H_{min}$) of the length of the single filament fiber having the greatest length ($H_{max}$) constituting the composite yarn to the length of the single filament fiber having the least length ($H_{min}$) constituting the composite yarn, and R (h) is the ratio ($h_{i+1}/h_i$), to the length ($h_i$) of any single filament constituting the composite yarn, of the length ($h_{i+1}$) of the single filament constituting the composite yarn which length is greater than and closest to ($h_i$).

13. A false twise yarn as set forth in claim 12, wherein each filament of non-circular cross section is of rotation-asymmetric cross section having a base and a degree of flatness and a degree of projection satisfying the following relations (III) and (IV)

degree of flatness (F):

$$L/W\geqq 4.5 \quad \text{(III)}$$

degree of projection (T):

$$0.15=H/L\leqq 0.4 \quad \text{(IV)}$$

where:

L: longest distance in cross section of coarse filament, W: radius of greatest inscribed circle in cross section of coarse filament, H: distance from front end of projection to straight line connecting opposite ends of longest distance of coarse filament.

14. A denier-mixed shrinkage-mixed composite yarn composed of a high-shrinkage component and a low-shrinkage component, at least said low-shrinkage component containing 20 weight percent or more coarse filaments whose single filament fineness is 3 deniers or more and 5 weight percent or more fine filaments whose single filament fineness is 1.5 denier or less, characterized in that part or all of said coarse filaments are of non-circular cross-section, the stress of said composite yarn at 10% elongation is 2.5 g/d or less, and the following relations (I) and (II) are satisfied:

$$E_{max}-E_{min}\geqq 20\ (\%) \quad \text{(I)}$$

$$E_{i+1}-E_i=20\ (\%) \quad \text{(II)}$$

where Emax is the elongation (%) of the maximum elongation single filament constituting the composite yarn, $E_{min}$ the elongation (%) of the single filament exhibiting minimum elongation, $E_i$ the elonation (%) of any single filament (excluding the maximum elongation single filament) constituting the composite yarn, and $E_{i+1}$ the elongation (%) of the single filament which exhibits elongation greater than and closest to $E_i$.

15. A denier-mixed shrinkage-mixed composite yarn as set forth in claim 14, wherein each of the high- and low-shrinkage components contains 20 weight percent or more coarse filaments whose single filament fineness is 3 deniers or more, and 5 weight percent or more fine filaments whose single filament fineness is 1.5 denier or more.

16. A denier-mixed shrinkage-mixed composite yarn as set forth in claim 14, wherein each filament of non-circular cross section is of rotation-asymmetric cross section having a base and a projection and has a degree of flatness and a degree of projection satisfying the following relations (III) and (IV)

degree of flatness (F):

$$L/W\geqq 4.5 \quad \text{(III)}$$

degree of projection (T):

$$0.15 = H/L \leqq 0.4 \quad \text{(IV)}$$

where:

L: longest distance in cross section of coarse filament,

W: radius of greatest inscribed circle in cross section of coarse filament, H: distance from front end of projection to straight line connecting opposite ends of longest distance of coarse filament.

* * * * *

UNITED STATES PATENT AND TRADEMARK OFFICE

CERTIFICATE OF CORRECTION

PATENT NO. : 4,712,366

DATED : December 15, 1987

INVENTOR(S) : Keizo Tsujimoto; Takashi Katagiri; Eiji Ichihashi
Hitoshi Otsubo

It is certified that error appears in the above—identified patent and that said Letters Patent is hereby corrected as shown below:

Column 10, line 13, "15 used" should read --is used--

Column 13, line 11, "a drawn" should read --a draw--

Column 14, line 10, "attached o" should read --attached to--
line 34, "were assessed" should read --was assessec Column 16, line 66, "under conditions" should read --under the conditions--

Signed and Sealed this

Seventh Day of June, 1988

*Attest:*

*Attesting Officer*

DONALD J. QUIGG

*Commissioner of Patents and Trademarks*